United States Patent [19]

Stark et al.

[11] 4,224,877

[45] Sep. 30, 1980

[54] RAILWAY HOPPER CAR CLOSURE ACTUATING MECHANISM

[75] Inventors: Marvin Stark, Houston, Tex.; Ronald G. Schultz, Country Club Hills, Ill.; Robert A. Spychalski, Michigan City, Ind.

[73] Assignee: Pullman Incorporated, Chicago, Ill.

[21] Appl. No.: 910,059

[22] Filed: May 26, 1978

[51] Int. Cl.[2] ..... B61D 7/04; B61D 7/18; B61D 7/26; B61D 7/28

[52] U.S. Cl. ..... 105/250; 105/240; 105/251; 105/310

[58] Field of Search ..... 105/240, 241 C, 248, 105/249, 250, 251, 252, 253, 308 R, 308 P, 310

[56] References Cited

U.S. PATENT DOCUMENTS

| | | | |
|---|---|---|---|
| 3,315,616 | 4/1967 | Beaver et al. | 105/248 |
| 3,316,857 | 5/1967 | Floehr | 105/240 |
| 3,515,075 | 6/1970 | Damy | 105/249 |
| 3,581,672 | 6/1971 | Aquino | 105/240 |
| 3,596,608 | 8/1971 | Aquino et al. | 105/253 |
| 3,608,500 | 9/1971 | Floehr | 105/240 |
| 4,051,960 | 10/1977 | Raksani | 105/241 C |
| 4,138,948 | 2/1979 | Korolis | 105/252 X |

*Primary Examiner*—John J. Love
*Assistant Examiner*—Howard Beltran
*Attorney, Agent, or Firm*—Richard J. Myers; Stephen D. Geimer

[57] ABSTRACT

An apparatus for pivoting and locking a door on the bottom of a rail hopper car includes a locking mechanism for locking the door when closed and a lever mechanism for pivoting the door between closed and open positions. The locking mechanism and lever mechanism are separate but are operated by a single sliding operating linkage on the bottom of the car.

10 Claims, 10 Drawing Figures

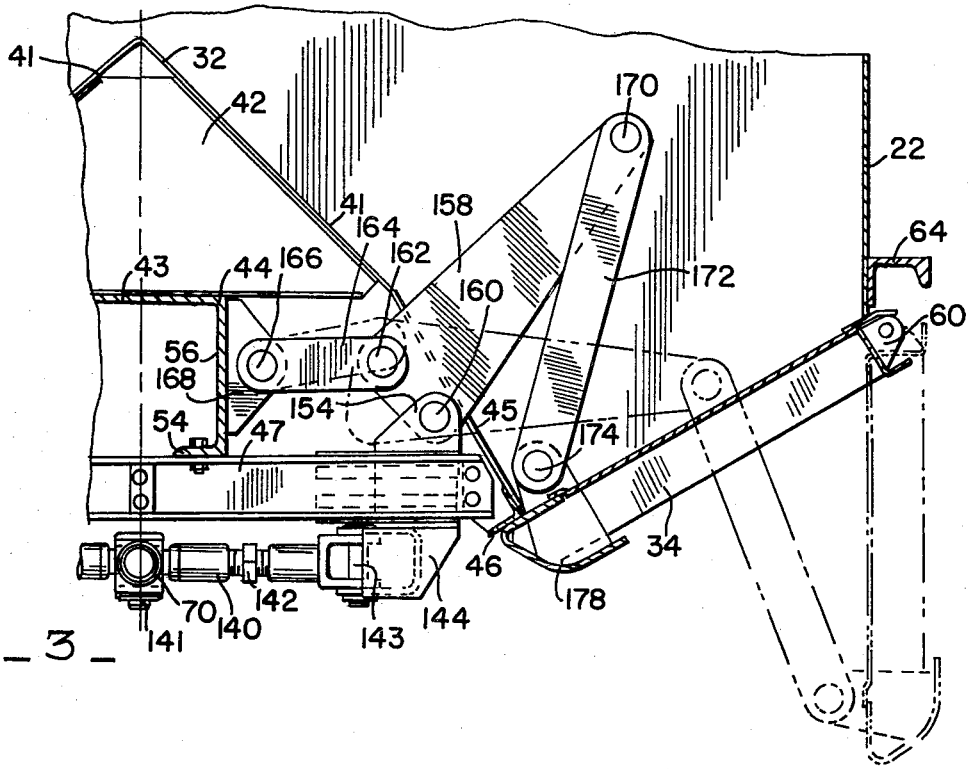
FIG. 3
FIG. 4
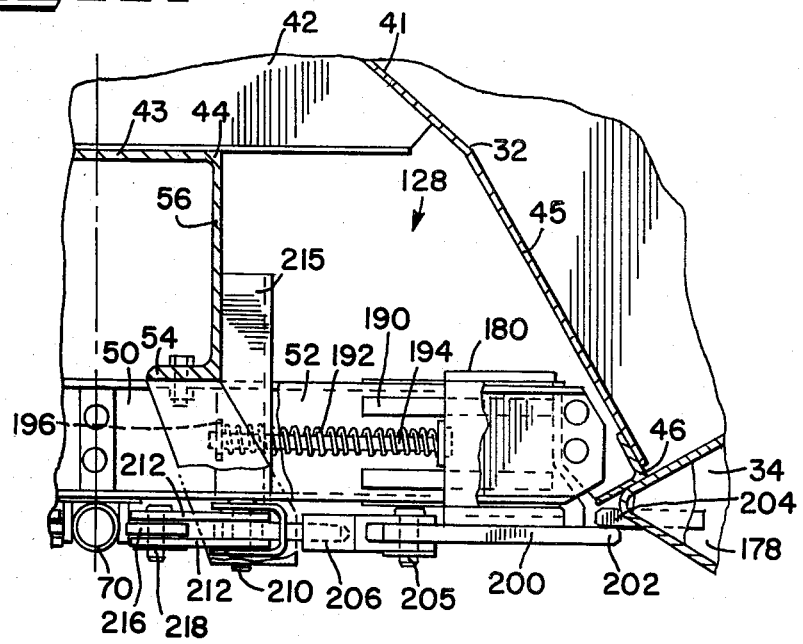

RAILWAY HOPPER CAR CLOSURE ACTUATING MECHANISM

BACKGROUND OF THE INVENTION

1. Field of the Invention

This invention relates to vehicles such as rail hopper cars, and particularly, to bottom door mechanisms for discharging material from such vehicles.

2. Description of the Prior Art

The prior art contains a number of hopper car structures with bottom door mechanisms. However, the prior art is generally characterized by one or more deficiencies such as failure to provide positive locking of the bottom door, being excessively complex and expensive, being difficult to maintain or repair, being subject to opening from the load on the doors, etc.

SUMMARY OF THE INVENTION

The invention is summarized in an apparatus for opening and closing a door hinged on a bottom of a hopper rail car or the like including an operating linkage slidably mounted on the bottom of the car, a lever and link arrangement connected between the operating linkage and the door for pivoting the door between open and closed positions in response to sliding movement of the operating linkage, a locking bar slidably mounted on the bottom of the car for moving between locked and unlocked positions, the locking bar in the locked position engaging the door in the closed position to hold the door closed, and a lock actuator assembly operated by the operating linkage for moving the locking bar to the unlocked position when the operating linkage slides toward a position to operate the lever and link arrangement to open the door.

An object of the invention is to construct a new and improved door operating apparatus or mechanism with a door pivoting lever and link arrangement and a separate positive door lock but with a single operating linkage for both the lever and link arrangement and the door lock.

Another object of the invention is to construct a door operating mechanism which can be adjusted, maintained and repaired with the doors closed and the car loaded.

Still another object of the invention is to construct a door operating mechanism with a single operating linkage having a range of movement wherein a first portion of the range of movement unlocks or locks the door and a second portion of the range of movement opens and closes the door.

One advantage of the invention is that a longitudinal side discharge door operating mechanism is made more simple and less complex.

Another advantage of the invention is that a door link and lever arrangement has an over-center locking position to provide a second lock in addition to a separate positive lock.

One feature of the invention is that door closing and door locking mechanisms are independently adjustable for car variances.

Another feature of the invention is that it may be utilized for any size vehicle, for example a hopper car having either two or four doors.

A further feature of the present invention is the provision of a lock on a moving mechanism for an operating linkage further insuring that a door is maintained closed while carrying a load.

Other objects, advantages and features of the invention will be apparent from the following description of the preferred embodiment taken in conjunction with the accompanying drawings.

BRIEF DESCRIPTION OF THE DRAWINGS

FIG. 3 is a cross section view taken at line 3—3 in FIG. 2.

FIG. 4 is a cross section view taken at line 4—4 in FIG. 2.

DESCRIPTION OF THE PREFERRED EMBODIMENT

Figure 1:
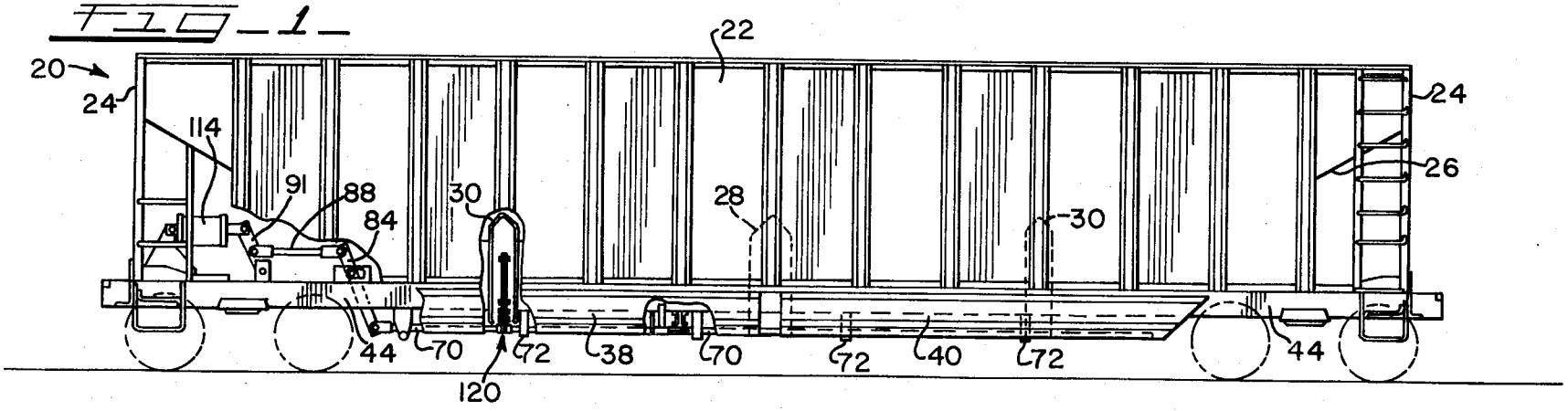
FIG. 1 is a side-view with portions broken away of a rail car in accordance with the invention.
Figure 2:
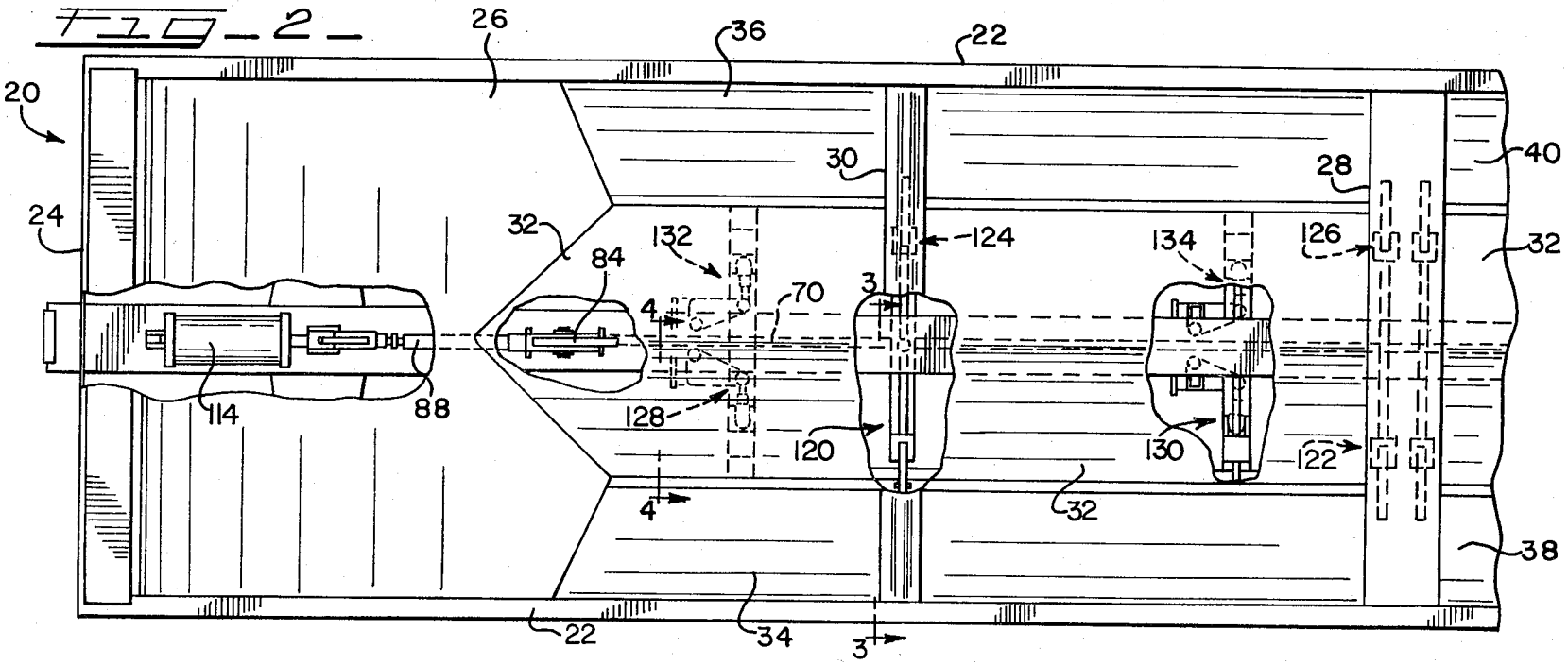
FIG. 2 is a top plan view with portions broken away of a portion of the car of FIG. 1.

As illustrated in FIGS. 1 and 2, the invention is embodied in a vehicle such as a rail way hopper car indicated generally at 20 and including conventional side wall structures 22 and end wall structures 24. A bottom or hopper portion of the car 20 is defined by two bottom end sheets 26, a tranverse center ridge 28, two transverse ridges 30, a longitudinal center ridge 32, and four doors 34, 36, 38 and 40. The bottom end sheets 26 slope downwardly and inwardly from the end wall structures 24. The transverse center ridge 28 extends across the bottom between the side wall structures 22 centrally between the end sheets 26 and is formed by a channel-shaped sheet with an inverted U-shaped cross section. The transverse ridges 30 are positioned between the respective end sheets 24 and the center ridge 28 and are also formed by channel-shaped sheets with inverted U-shaped cross sections; these ridges 30 extend across the bottom between the side wall structures 22 in a manner similar to the ridge 28. The longitudinal center ridge 32 is formed by four bent sheet segments, two sheet segments extending between the end sheets 26 and the ridges 30, respectively, and the other two sheet segments extending between the respective transverse ridges 30 and the transverse center ridge 28. As illustrated in FIG. 3, this longitudinal center ridge 32 has an inverted generally V-shaped cross section with upper sheet portions 41 supported by members 42 on an upper plate 43 of a center sill 44 and with lower sheet portions 45 attached at their lower edges to longitudinal door jamb members 46 mounted on the ends of transverse channel support members (see 47 and 48 in FIGS. 3 and 8, and see 50 and 52 in FIGS. 4 and 9) which are fastened on inwardly extending bottom flanges 54 of side walls 56 of the center sill 44. The upper sheet portions 41 extend downward and outward from an apex of the longitudinal ridge 32 at a first slope while the lower sheet portions 45 extend downward and outward at a second slope which is substantially greater than the first slope. The doors 34, 36, 38 and 40, FIG. 2, are hinged by hinges 60, FIG. 3, on bottom side sills 64 of the side wall structures 22 for closing respective bottom hopper openings defined by the bottoms of the side structures 22, the longitudinal center ridge 32, the end sheets 26 and the transverse center ridge 28. The doors 34, 36, 38 and 40 are longitudinal doors which cooperate with the center ridge 32 for forming a side discharge (outside the rails) of the hopper car. The number of doors may be varied in accordance with the size of the car; for example only one longitudinal door per side can be provided on a smaller car.

Figure 5:
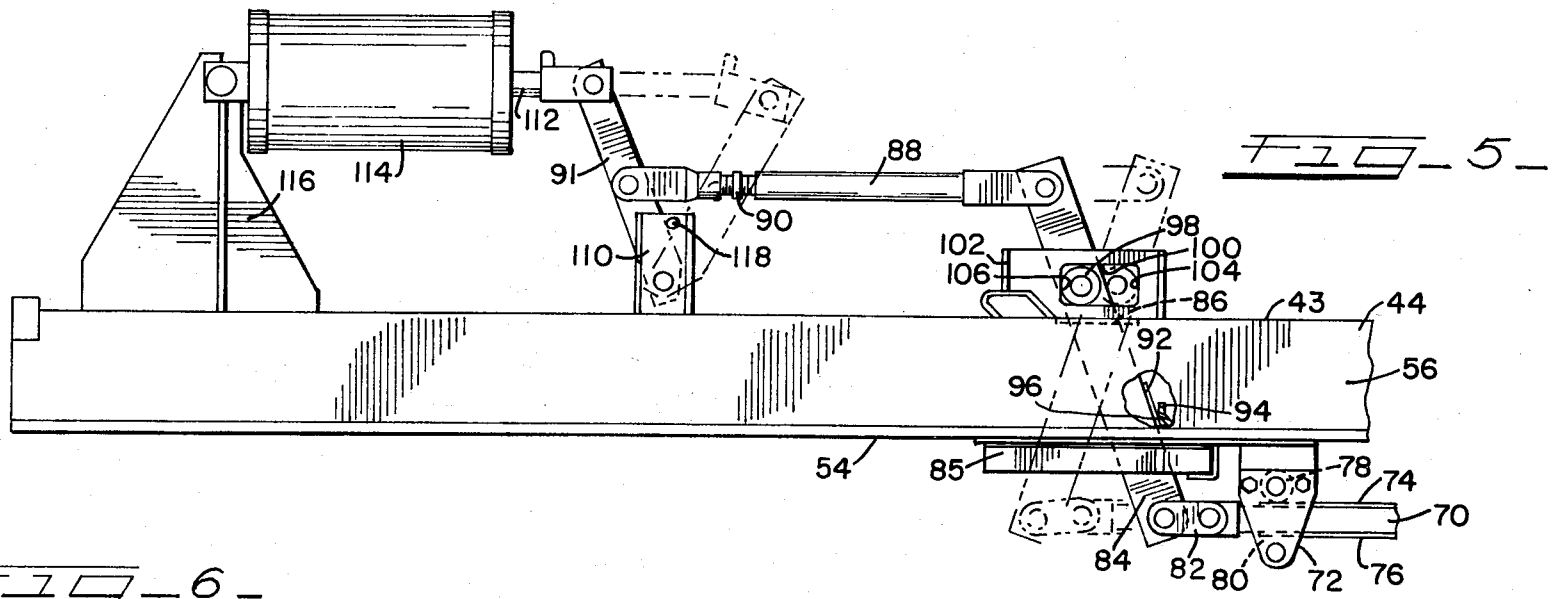
FIG. 5 is a side view of a mechanism for moving an operating linkage of a door operating apparatus of the car of FIG. 1.

An apparatus for operating the doors 34, 36, 38 and 40 includes a single longitudinal operating linkage 70 as shown in FIG. 1, slidably mounted within brackets 72 extending down from the longitudinal center sill 44. As shown in FIG. 5 the linkage 70 includes a pair of bearing surface plates 74 and 76 on the upper and lower sides thereof which are engaged by rollers 78 and 80 in the bracket 72 at the left end of the hopper car as shown in FIG. 1. The brackets 72 slidably hold the linkage 70 spaced sufficiently below the sill 44 to extend underneath the transverse channel support members 47, 48, 50 and 52, as shown in FIGS. 3 and 4. The left end of the linkage 70 as illustrated in FIG. 5 is coupled by links 82 to the bottom end of a drive pivot lever 84 which extends upward between guides 85 mounted on the bottom flanges 54 of the sill 44 and extends through the center of the sill 44 and upward through an opening 86 in the top of the sill 36. The upper end of the lever 84 is pivotally connected to one end of a link 88 which includes an adjustment screw device 90 for adjusting the length of the link 88 and which is pivotally connected at its other end to an intermediate point of a lever 91. The lever 84 includes a bearing surface member 92 on its right side edge facing a cross bar member 94 mounted transversely across the open center of the sill 44 between the side walls 56 of the sill 44. The cross bar member 94 has a sharp longitudinal bend therein to form a pivot or fulcrum edge 96 protruding toward the bearing surface member 92. The lever 84 also has rollers 98 thereon extending through openings 100 in a bracket 102 mounted on the top 43 of the sill 44. The openings 100 are elongated in a direction parallel to the sill 44 and have right ends defined by edges 104 on the bracket 102 and left ends defined by edges 106 for engaging the rollers 98 but permitting a predetermined length of travel of the rollers 98 between the edges 104 and 106 at the ends of the opening 100. The position of the fulcrum 96 is selected toward the bottom end of the lever 84 to produce a first predetermined mechanical advantage in force applied to linkage 70 during pivotal movement of the lever about the fulcrum 94 while the position of the rollers 98 is selected toward the upper end of the lever 84 to produce a second predetermined mechanical advantage in force applied to the linkage 70; the first mechanical advantage producing substantially greater force than the second mechanical advantage on the linkage 70 but the second mechanical advantage producing substantially greater length and speed of movement of the linkage 70 than the first mechanical advantage. The lever 91 is pivotally mounted at its lower ends by a bracket 110 on the top 43 of the sill 44 and at its upper end to a piston rod 112 extending from an air cylinder 114 mounted on a bracket 116 on top of the sill 44. A locking pin 118 is removably mounted in the bracket 110 for engaging the right edge of the lever 91 to hold the levers 84 and 91 in their most counter clockwise position and to hold the linkage 70 in its most right position as viewed in FIG. 5.

Alternately the air cylinder 114 and piston rod 112 for operating the linkage 70 can be left out and the lever 91 can be operated by manual means.

Referring back to FIGS. 1 and 2, the linkage 70 is connected by lever and link assemblies generally indicated at 120 and 122 to the door 34 and is connected by lever and link assemblies generally indicated at 124 and 126 to the door 36. Positive door lock assemblies generally indicated at 128 and 130 for the door 34 and at 132 and 134 for the door 36 are also operatively associated with the linkage 70. Similar lever and link assemblies and positive door lock assemblies for the doors 38 and 40 are also operatively associated with the linkage 70. The number of lever and link assemblies and the number of positive door lock assemblies for each of the bottom hopper doors for the hopper car may be varied depending on the size of the doors and the material carried by the hopper car. The lever and link assemblies 120, 122, 124 and 126 are substantially similar while the door lock assemblies 128, 130, 132 and 134 are also substantially similar except that the assemblies for the door 36 are mirror images of the assemblies for the door 34.

Figure 7:
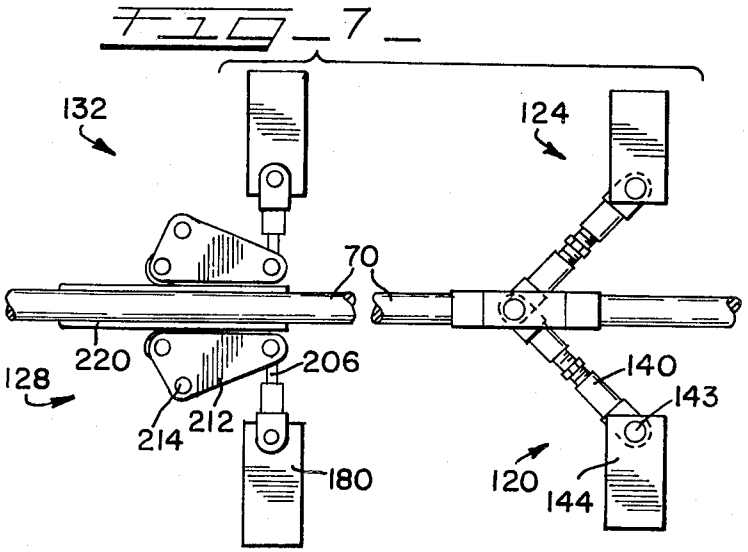
FIG. 7 is a view similar to FIG. 6 but when the doors are in an open position.
Figure 6:
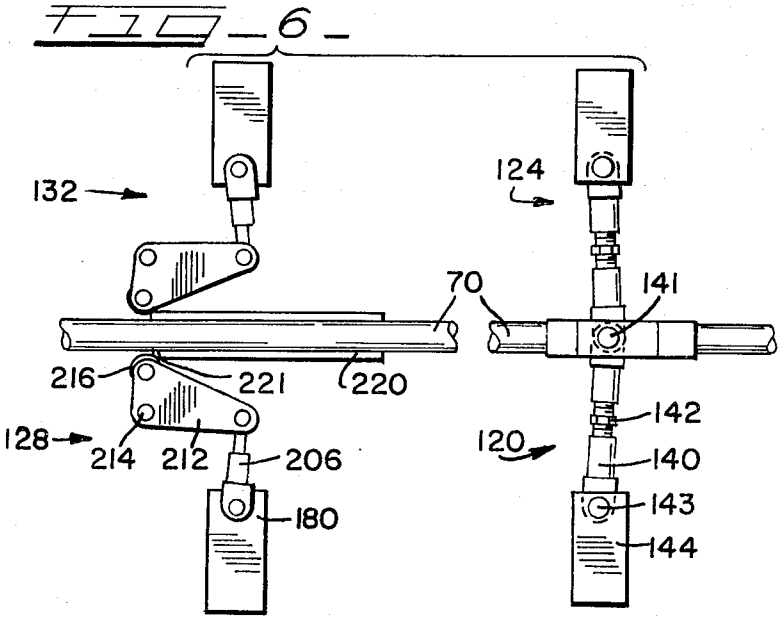
FIG. 6 is a plan view of portions of a pair of lever and link arrangements for pivoting a pair of doors and a pair of actuator mechanisms for a pair of door lock mechanisms of the car of FIG. 1 when the doors are in a closed and locked position.
Figure 8:
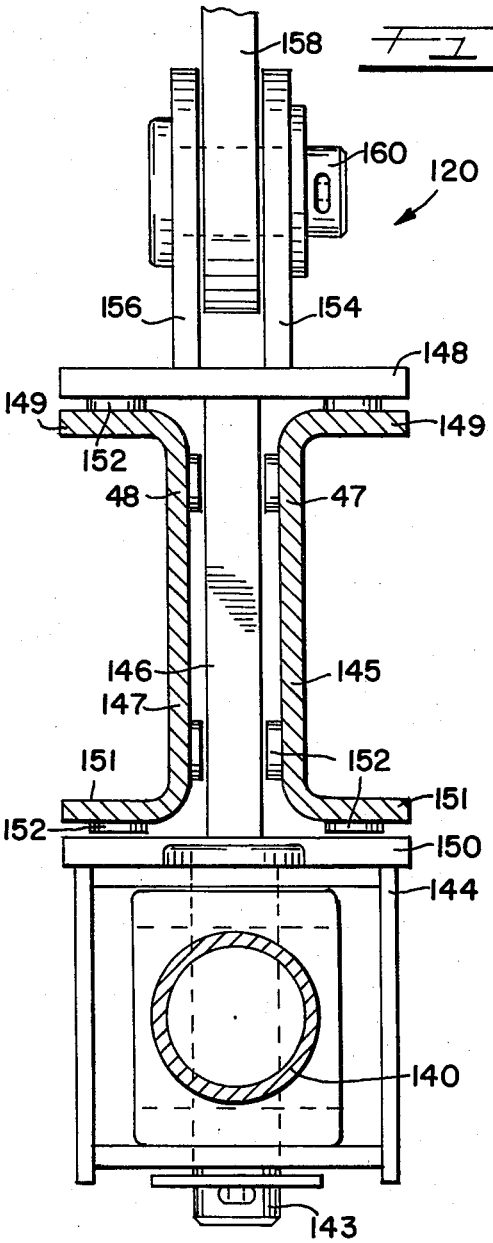
FIG. 8 is a cross-section view of a pair of transverse supports and a door link and lever arrangement of the car of FIG. 1.
Figure 9:
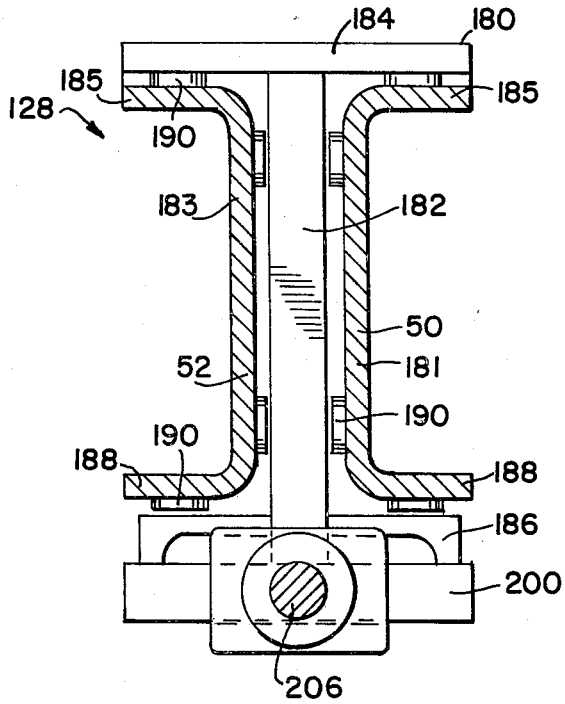
FIG. 9 is a cross-section view of a pair of transverse channel supports and a door lock mechanism of the car of FIG. 1.

As shown in FIGS. 3, 6 and 7, the lever and link assembly 120 includes a link 140 with a threaded length adjusting member 142 and is pivotally connected by a pin 141 at one end to the linkage 70 and pivotally connected by a pin 143 at the other end to a carriage 144. This carriage as shown in FIG. 8, has a central plate member 146 extending between facing central portions 145 and 147 of the spaced parallel transverse channel support members 47 and 48 and has upper and lower plate members 148 and 150 extending above and below respective upper and lower outward extending flange portions 149 and 151 of the support members 47 and 48. Slide bearing members 152 are provided on inner surfaces of the central portions 145 and 147 of the channel support members 47 and 48 as well as on the upper surfaces of the upper flange portions 149 and the lower surfaces of the lower flange portions 151 for slidingly engaging and guiding the carriage 144 along the channel support members 47 and 48. A pair of parallel clevis extensions or portions 154 and 156 on the top of the carriage 144 pivotally support a multiple lever 158 by means of a pivot pin 160. As shown in FIG. 3, the multiple lever 158 has a general configuration of an isosceles triangle with the equal sides thereof being much longer than the other or base side of the triangle. The pivot pin 160 is pivotally connected to the corner between the lower elongated side and the short base side of the lever 158. A pivot pin 162 joins the corner between the short base side and the upper elongated side of the multiple lever 158 to one end of a horizontal pivot link 164 which is pivotally joined at its other end by a pin 166 to a flange 168 mounted on one side wall 56 of the sill 36. The pivot points 160 and 162 on the multiple lever 158 are closely spaced at the base or supported end of the lever 158. The distal end or the corner between the upper and lower elongated sides of the lever 158 is pivotally joined by a pin 170 to one end of a door link 172 which has its other end connected by a pin 174 to a bracket on a longitudinal door edge portion 178 of the door 34 opposite the hinge 60. In the door closed position when the carriage 144 is advanced to the right as shown in FIG. 3, the distal end of the lever 158 extends upward and to the right as shown in solid lines; in the door open position when the carriage 144 is retracted to the left, the distal end of the lever 158 extends generally horizontally to the right as shown in dashed lines. The lever and linkage assembly 120 is positioned within the ridge member 30, FIG. 1, underneath the bottom of the hopper.

Conventional door stops (not shown) are incorporated into the side construction of the car to limit the swing of the door 34 and to thus eliminate extreme forces on the lever and linkage assembly 120.

The lever and linkage assembly 124 for the door 56, FIGS. 2, 6 and 7, is also joined by the pivot pin 141 to the linkage 70 and extends in the opposite direction from the linkage 70 so as to exert forces perpendicular to the linkage 70 which oppose and cancel the forces generated by the linkage and lever assembly 120 perpendicular to the linkage 70. Similarly the linkage and lever assemblies 122 and 126 are joined to the linkage 70 to produce cancelling forces perpendicular to the linkage 70.

Figure 10:
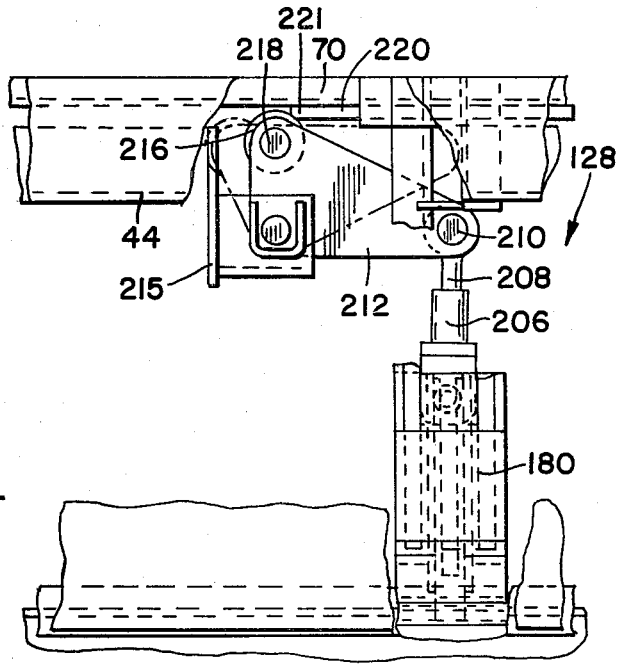
FIG. 10 is a plan view of a positive door lock assembly of the car of FIG. 1.

In the door lock assembly 128 shown in FIGs. 4, 6, 7, 9 and 10, a door lock carriage 180 has a center plate member 182 extending between facing center portions 181 and 183 of the spaced parallel transverse channel support members 50 and 52 and has an upper plate-like member 184 extending over upper outward extending flange portions 185 of the channel support members 50 and 52 and a lower plate-like member 186 extending beneath lower outward extending flange portions 188 of the transverse channel support members 50 and 52. Slide bearing plates 190 are mounted on the inner surfaces of center portions 181 and 183 as well as on the respective top and bottom surfaces of the flange portions 185 and 188 for slidably engaging and guiding the carriage 180. A compression spring 192 is disposed between the carriage 180 and a cross bar 196 mounted between the channel supports 50 and 52 for biasing the carriage 180 to the right as shown in FIG. 4. A guide rod 194 extending from the carriage 180 and slidably received by the cross bar 196 extends through the center of the spring 192. A door locking bolt 200 is mounted on the bottom of the carriage 180 and has one end 203 extending underneath a tongue 204 mounted on the edge member 178 of the door 34 when the carriage 180 is in the right position as shown in FIG. 4 to lock the door 34 in the closed position. The other end of the bolt 200 is pivotally connected by a pin 205 to a link 206 which includes thread means 208 for adjusting its length and which is connected at its other end by a pin 210 to one corner of parallel actuator levers or plates 212 pivotally mounted by a pin 214, FIG. 10, on a bracket 215 on the center sill 44. An actuator roller or cam roller 216 is rotatably mounted on a pin 218 between the plates 212 adjacent to the linkage 70 in the path of an actuator or cam plate 220 mounted on one side of the longitudinal operating linkage 70. The plate 220 extends from its forward end 221 adjacent the roller 216 to the right as shown in FIGS. 6 and 10. As shown in FIG. 10, the actuator plates have a generally right-triangular configuration with the pivot point 214 in the right angle corner. The roller 216 is located in the corner between the hypotenuse side and a shorter side of the two sides extending from the right angle corner; this shorter side extends generally perpendicular to the linkage 70 when the door lock assembly 120 is in a door locked position as shown in solid lines. The pivot 210 is located in the corner between the hypotenuse side and the longer side from the right angle corner; in the door locked position this longer side extends generally parallel the linkage 70 as shown in solid lines, but in the door unlocked position this longer side extends from the right angle corner toward the linkage 70 as shown in dashed lines. The actuator plates 212, pivots 210 and 214, and roller 216 form a cam follower arm arrangement for retracting the link 206 and carriage 180 against the bias of spring 192.

As shown in FIGS. 6 and 7 the door lock assembly 132 is directly on the opposite side of the longitudinal operating linkage 70 from the assembly 128 so as to generate forces perpendicular to the linkage 70 which directly oppose and cancel the perpendicular forces produced on the linkage 70 by the locking assembly 128. Similarly the other locking assemblies, such as locking assemblies 130 and 134 for the doors 34 and 36 shown in FIG. 2, are on opposite sides of the operating linkage 70 so as to produce cancelling forces perpendicular to the linkage 70.

The operating linkage 70 as shown in FIGS. 6 and 7 has first and second positions, respectively; the first position in FIG. 6 corresponding to the door closed and locked position and the second position in FIG. 7 corresponding to the door open position. In the door closed and locked position, the left edges 221 of the cam plates are positioned just to the right of the actuator rollers 216 of the door lock assemblies 128 and 132, and the links 140 of the lever and link assemblies 120 and 122 are positioned over center, i.e., pivoted so that the links 140 are just past perpendicular to the linkage 70 or so that the point 141 is just to the right of a straight line between the other ends of the links 140. The positions of the left edge 221 of the cam plates 220 and rollers 216 are such that the actuator rollers 216 are engaged and the actuator arms 212 are pivoted from the position shown in FIG. 6 to the position shown in FIG. 7 during a first portion of the range of movement of the linkage 70; this first portion of movement being simultaneous when the links 140 are pivoted through their center or perpendicular to linkage 70 prior to movement of the carriages 144. The cam plates 220 extend along the linkage 70 sufficiently to retain the actuator plates 212 pivoted and the carriages 180 retracted throughout the remaining portion of movement of the linkage 70 to the door fully open position.

In operation of the apparatus for opening and closing the bottom doors in the hopper rail car 20, the doors 34, 36, 38 and 40 are initially in a closed position with the longitudinal operating linkage 70 advanced to its right position as shown in FIGS. 1, 2, 5 and 6. In this position, the link 140 in the lever and link assembly 120 as well as the corresponding links in the other lever and link assemblies 122, 124, 126 are positioned over center or slightly to the right of a perpendicular line running from the pivot point 143 to the linkage 70. Since further movement of the linkage 70 to the right is prevented by the lever 84 engaging the fulcrum point 96 on the cross member 94 and the roller 98 engaging the end 106 of the opening 100 in the bracket 102, the assembly 120 is locked in this over-center position. The carriage 144 is held in an advanced position, to the right as shown in FIG. 3, holding the lever 158 with the pivot point 170 in a raised position to hold the door 34 in the closed position by means of the link 172 as shown in solid lines in FIG. 3. In the door locking assembly 130, the actuator roller 216 is disengaged from the cam plate 220 permitting the spring 192, FIG. 4, to hold the carriage 180 in the advanced position, to the right as shown in FIG. 4. The link 206 holds the actuator plates 212 in a clockwise position about the pivot 214 as shown in FIG. 6 and in solid lines in FIG. 10. The end 202 of the locking bolt 200 extends underneath the locking tongue 204, FIG. 4, of the door 34 locking the door 34 in the closed position.

Operation of the air cylinder 114, or manual means (not shown) if employed in place of the air cylinder 114, opens the doors 34, 36, 38, and 40. During this operation, the lever 91 pivots toward the position shown in dashed lines in FIG. 5. This in turn advances the link 88 to the right to pivot the lever 84 to the position shown in dashed lines. During a first portion of the pivotal movement of the lever 84, the lever 84 pivots about the fulcrum point 96 while the rollers 98 move within the opening 100 from the end 106 to the end 104. During this first portion of pivotal movement, the longitudinal operating linkage 70 is pulled to the left through a first portion of its movement engaging the cam plate 220 on the linkage 70 with the roller 216 to pivot the actuator plates 212 to the position shown in FIG. 7 and to pivot the link 140 from its over center position of FIG. 6 to a position where the link 140 is slightly to the left of a perpendicular from pivot point 143 to the linkage 70. This movement of the actuator plates 212 retracts the carriage 180 to the left as shown in FIG. 4 to withdraw the end 202 of the locking bolt 200 from underneath the tongue 204 on the door 34; thus the door 34 is unlocked by the withdrawal of lock assembly 128 as well as by the pivoting of link 140 from its over center position. During this door unlocking movement or the first portion of movement of the linkage 70, the carriage 144 remains in its advanced position.

The employment of a first fulcrum point 96 spaced on the lever 84 toward the linkage 70 relative to the rollers 98 producing a substantial mechanical advantage and greater force during this first portion of movement or unlocking movement reduces the amount of force required from the air cylinder 114, or manual means (not shown), to bring about unlocking of the slidable bolt 200 and the overcenter link 140. Thus a smaller air cylinder is needed than if this mechanical advantage were not employed.

After the rollers 98 have engaged the edges 104 bordering the right end of the slots 100 of the bracket 102, the lever 84 pivots about the rollers 98 to move the longitudinal operating linkage 70 to the door open position, to the left as shown in dashed lines in FIG. 5. This movement of the longitudinal operating linkage 70 results in the link 140 pulling the carriage 144 from the advanced or right position shown in FIG. 3 to the left to produce pivoting of the lever 158 downward about pivot 160 due to link 164 holding the pivot 162 at a fixed distance from the sill 44 as shown in dashed lines. Thus the link 172 is moved downward to swing the door 34 downward to the open position shown in dashed lines.

The employment of the rollers 98 spaced from the point 96 toward the upper end of the lever 84 for the remaining pivotal movement of the lever 84 results in more rapid movement of the linkage 70 to bring about a relatively rapid opening of the door 34 on the car without requiring a long stroke for the piston rod 112 of the air cylinder 114 or manual door opening means if employed. Thus a shorter air cylinder can be employed than if the lever 84 with two different mechanical advantages during first and second portions of its movement were not used.

After the car is unloaded, the doors 34, 36, 38 and 40 are closed by operating the air cylinder 114 to retract the piston rod 112. The lever 91 pivots counterclockwise pulling link 88 to pivot lever 84 counterclockwise. During an initial portion of this movement the lever 84 pivots about its connection to the link 82 while the rollers 98 move in the slots 100 from the end 104 to the end 106. Continued movement pivots the lever 84 about the rollers 98 until the lever 84 is stopped by engagement of the plate 92 against the crossbar. Thus the crossbar 94 also serves as a stop determining the closed position of the linkage 70.

The lever 84 during counterclockwise movement about rollers 98 pushes the linkage 70 to the right as shown in FIGS. 5 and 6. This results in link 140 pushing the carriage 144 to its advanced position of FIG. 3 raising the lever 158 and link 172 to close the door 34. After the door 34 has reached its closed position, a final portion of the movement of the linkage 70 brings about disengagement of the roller 216, FIG. 6, with the cam plate 220 permitting the spring 192, FIG. 4, to advance the carriage 180 and insert the end 202 of the locking bolt 200 under the tongue 204 of the door 34 to lock the door in the closed position. Also during this final portion of the movement of the linkage 70, the link 142 is pivoted overcenter to produce a second lock holding the door 34 closed. A third lock is provided by inserting the locking pin 118, FIG. 5, into the bracket 110.

The employment of a lever and link assembly together with a separate positive door lock assembly operated by a single operating linkage results in a substantial improved door operating apparatus. The door link and lever assembly or the positive door lock assembly may be adjusted or repaired with the door closed and the car loaded. The single operating linkage renders the door closing and opening apparatus relatively simple and easy to operate. Two or more locks insure that the doors are not opened by vibrations or the like.

It is noted that the link 140 of the link and lever door operating assembly, the link 206 of the door locking bolt assembly, and the link 88 of the operating mechanism for the linkage 70 are all independently adjustable. This permits their adjustment to accommodate for variances in door and hopper car structure.

Since the above described invention is subject to many modifications, variations and changes in detail, it is intended that all matter in the foregoing description and shown in the drawings be interpreted as illustrative and not in a limiting sense.

What is claimed is:

1. An apparatus for a railway hopper car that opens and closes a door hinged on a bottom of a hopper comprising:

an operating linkage slidably mounted on the bottom of the car, a pivoting lever and link arrangement pivotally connected between the operating linkage and the door for pivoting the door between open and closed positions in response to sliding movement of the operating linkage, a locking bar slidably mounted on the bottom of the car hopper for moving between locked and unlocked positions, said locking bar in the locked position engaging the door in the closed position to hold the door closed, and a lock actuator assembly having a drive connection that is separate from the connection between said lever and link arrangement and the operating linkage and being operated by the operating linkage for moving the locking bar to the unlocked position attendant to having the operating linkage move and operate the lever and link arrangement to subsequently open the unlocked door.

2. An apparatus as claimed in claim 1 for opening and closing doors longitudinally hinged on the bottom of the hopper rail car wherein the operating linkage extends longitudinally on the bottom of the car, the lever and link arrangement extends transversely to the operating linkage, and the locking bar extends transversely and is slidable transversely to the operating linkage.

3. An apparatus as claimed in claim 1 including means biasing the locking bar to the closed position; and wherein the lock actuator assembly includes an actuator lever, a link connecting the actuator lever to the locking bar, cam means mounted on the operating linkage, a cam follower on the actuator lever for engaging the cam means to pivot the lever to move the locking bar to the unlocked position against the biasing means when the operating linkage is moved.

4. An apparatus as claimed in claim 3 wherein the lever and link arrangement includes a carriage slidably mounted on the bottom of the car transverse to the operating linkage, a connecting link coupled between the operating linkage and the carriage, a multiple lever pivotally mounted on the carriage, a pivot link coupled between the car and the multiple lever so as to cause the multiple lever to pivot to a raised position when the carriage is in an advanced position and to pivot the multiple lever to a lower position when the carriage is in a retracted position, a door link coupling the free end of the multiple lever to the free side of the door to move the door between open and closed positions in response to movement of the carriage between advanced and retracted positions, and said connecting link having a over center position when the operating linkage is in a door locking position;

the operating linkage is movable from its door locking position through a door unlocking portion of movement and then through a door opening portion of movement;

the apparatus includes means for moving the operating linkage through its door locking movement and its door opening movement; and said cam on the operating linkage and said cam follower on the actuator lever being positioned so that the actuator lever is pivoted to withdraw the locking bolt during the door unlocking movement of the operating linkage.

5. An apparatus as claimed in claims 1 or 3 wherein the lever and link arrangement includes a carriage slidably mounted on the bottom of the car for sliding movement transverse to the operating linkage, a connecting link connecting the carriage to the operating linkage, a multiple lever pivotally mounted on the carriage, a pivot link connected to a pivot point on the multiple lever and to the car so as to pivot the multiple lever with its free end raised when the carriage is in an advanced position and to lower the free end of the multiple lever when the carriage is in a retracted position, and a door link connecting the free end of the multiple lever to the door so as to raise and lower the door between closed and open positions.

6. An apparatus as claimed in claims 1, 3 or 4 including a drive pivot lever extending transverse to the longitudinal operating linkage and pivotally connected at one end thereof to the operating linkage, means for applying a pivoting force to the other end of the drive pivot lever, a fulcrum mounted on the car for engaging the lever at a first position between the one and other ends of the lever during a first movement of the longitudinal operating linkage from an unoperated position to an operated position, a pivot means extending from the sides of the lever at a point intermediate the fulcrum engaging point on the lever and the other end of the lever, and pivot engaging means including a slot receiving the pivot means extending from the lever to permit the lever to pivot about the fulcrum from one end of the slot to the other end of the slot wherein subsequent pivotal movement of the lever occurs about the pivot means and away from the fulcrum to move the longitudinal operating linkage.

7. An apparatus for opening and closing a door hinged on the bottom of a railway car or the like comprising:

an operating linkage slidably mounted on the bottom of the car, means connected between the operating linkage and the door for pivoting the door between open and closed positions in response to movement of the operating linkage over a first range of movement thereof, a locking bar for engaging the door in a closed position to hold the door closed, means connected between the locking bar and the operating linkage for moving the locking bar between door locking and unlocking positions in response to movement of the operating linkage over a second range of movement thereof, a drive pivot lever extending transverse to the operating linkage and pivotally connected at one end thereof to the operating linkage, means for applying a pivoting force to the other end of the drive pivot lever, a fulcrum mounted on the car for engaging the lever at a first point which is located so that a relatively small pivoting force is required to move the lever through said second range of movement of the operating linkage, means providing another fulcrum mounted on the car for engaging the lever at the second point which is spaced from said first point toward the other end of the lever, said lever engaging said other fulcrum after the operating linkage has been moved through said second range of movement.

8. For a railway hopper car having a bottom discharge opening and including a pivotally mounted hopper door movable between a closed position covering said discharge opening and an open position away from said discharge opening, a door operating mechanism for moving said door between said open and closed positions comprising:

an operating linkage slidably mounted on the bottom of the car, linkage means operatively connected between said operating linkage and said door for pivoting said door between said open and closed positions attendant to sliding movement of said operating linkage, door locking means including a locking bar movable between a door engaging locked position and an unlocked position, said door locking means including lock actuating means operatively connected between said operating linkage and said locking bar for moving said locking bar between said locked and unlocked positions attendant to sliding movement of said operating linkage, and means for moving said operating linkage.

9. The invention in accordance with claim 8, wherein said means for moving said operating linkage includes a pivot lever having first and second ends, the first end of said pivot lever being pivotally connected to said operating linkage, and means for exerting a pivoting force on the second end of said lever.

10. The invention in accordance with claim 9, including first and second fulcrum means mounted on said railway car, said fulcrum means providing said pivot lever with first and second fulcrum points, said first fulcrum point being closer to said first end of said lever than the second end and said second fulcrum point being closer to said second end of said lever than the first ends whereby said pivot lever pivots about one of said first and second fulcrums when said means for exerting pivoting force to the second end of said lever is actuated to slidably move said operating linkage.

* * * * *